US010633918B2

(12) United States Patent
Wulfekotte

(10) Patent No.: US 10,633,918 B2
(45) Date of Patent: Apr. 28, 2020

(54) LADDER STORAGE RECEPTACLE

(71) Applicant: Patrick Wulfekotte, Brick, NJ (US)

(72) Inventor: Patrick Wulfekotte, Brick, NJ (US)

( * ) Notice: Subject to any disclaimer, the term of this patent is extended or adjusted under 35 U.S.C. 154(b) by 72 days.

(21) Appl. No.: 15/900,686

(22) Filed: Feb. 20, 2018

(65) Prior Publication Data

US 2018/0238113 A1 Aug. 23, 2018

Related U.S. Application Data

(60) Provisional application No. 62/461,189, filed on Feb. 20, 2017.

(51) Int. Cl.

| | |
|---|---|
| ***E06C 7/14*** | (2006.01) |
| ***B25H 3/06*** | (2006.01) |
| ***E06C 1/20*** | (2006.01) |
| ***E06C 7/16*** | (2006.01) |

(52) U.S. Cl.

CPC ..... *E06C 7/14* (2013.01); *B25H 3/06* (2013.01); *E06C 1/20* (2013.01); *E06C 7/16* (2013.01)

(58) Field of Classification Search

CPC ..... E06C 7/14; E06C 7/16; E06C 1/20; B25H 3/06

See application file for complete search history.

(56) References Cited

U.S. PATENT DOCUMENTS 4,653,713 A * 3/1987 Hamilton ..... B25H 3/02 182/129
4,768,651 A * 9/1988 Lanius ..... A01K 97/06 206/315.1
4,773,535 A * 9/1988 Cook ..... A45C 3/00 206/373
D317,206 S * 5/1991 Cagle ..... D25/68
5,259,480 A * 11/1993 Bartnicki ..... E06C 7/14 182/129
5,503,571 A * 4/1996 Cheslock ..... B65H 75/42 206/372
5,603,405 A * 2/1997 Smith ..... E06C 7/14 182/129
5,782,314 A * 7/1998 Zeitler ..... E06C 7/14 182/129
5,836,557 A * 11/1998 Bailey ..... E06C 7/14 248/210
5,873,433 A * 2/1999 Katz ..... E06C 7/14 182/129
5,901,998 A * 5/1999 Gallo, Jr. ..... E06C 7/14 182/129
5,941,344 A * 8/1999 Spadaro ..... E06C 7/14 182/129
5,950,972 A * 9/1999 Irish ..... E06C 7/14 182/121
5,967,259 A * 10/1999 Williams ..... E06C 7/14 182/129

(Continued)

*Primary Examiner* — Katherine W Mitchell
*Assistant Examiner* — Shiref M Mekhaeil
(74) *Attorney, Agent, or Firm* — Wei & Sleman LLP

(57) ABSTRACT

A storage-receptacle for attachment to a ladder; the storage-receptacle includes a tray-housing having a tray-capacity, four tray-sides, a tray-base and an open-top; and an attachment-means fixedly-attached to one of the four tray-sides configured to secure the storage-receptacle to a top-step of the ladder. The storage-receptacle is useful for providing easily accessible tools for a user.

16 Claims, 5 Drawing Sheets

(56) References Cited

U.S. PATENT DOCUMENTS 5,971,102 A * 10/1999 Brown ..... E06C 7/003 182/129
D427,771 S * 7/2000 Trejo ..... D3/315
6,098,748 A * 8/2000 Harper, Jr. ..... B25H 3/02 182/129
6,334,509 B1 * 1/2002 Ryszkiewicz ..... B25H 3/00 182/129
6,401,862 B1 * 6/2002 Caron ..... E06C 7/14 182/120
6,443,260 B1 * 9/2002 Katz ..... B25H 3/06 182/129
6,564,941 B2 * 5/2003 Hedges ..... B25H 3/00 182/129
7,032,711 B1 * 4/2006 Katz ..... B25H 3/06 182/129
7,055,652 B1 * 6/2006 Williams ..... B25H 3/00 182/129
7,156,205 B2 * 1/2007 Wilson ..... E06C 1/39 182/129
7,195,119 B2 * 3/2007 Lungo ..... E06C 7/14 182/129
D541,432 S * 4/2007 Rapp ..... D25/68
D547,460 S * 7/2007 Asham ..... D25/68
7,264,084 B1 * 9/2007 Switzer ..... E06C 7/14 182/129
7,370,726 B1 * 5/2008 Chavez ..... E06C 1/18 182/129
D636,896 S * 4/2011 Gemma ..... D25/68
8,151,938 B2 * 4/2012 Kinskey ..... A45C 5/00 182/129
8,453,796 B2 * 6/2013 Astor ..... E06C 7/14 182/119
8,667,908 B2 * 3/2014 Martin ..... A47B 3/06 108/153.1
8,863,901 B1 * 10/2014 Kyle ..... B25H 3/022 182/129
9,359,819 B1 * 6/2016 Valadez ..... E06C 7/14
9,714,542 B1 * 7/2017 Harcz ..... E06C 7/14
2002/0104709 A1 * 8/2002 Hines ..... B25H 3/006 182/129
2018/0106109 A1 * 4/2018 Boller ..... E06C 7/44

* cited by examiner

LADDER STORAGE RECEPTACLE

CROSS REFERENCE TO RELATED APPLICATION

The present application is related to and claims priority to U.S. Provisional Patent Application No. 62/461,189 filed Feb. 20, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of receptacles and more specifically relates to a storage receptacle for attachment to a ladder.

2. Description of Related Art

Ladders usually contain a top platform, or top step that is used for providing structural integrity to the ladder and is not used for stepping. When a user works at the top of the ladder, the user often finds that picking up extra supplies or tools from the ground level is time consuming and inefficient. People may try to hold multiple tools in their hands, or in their pockets, only to put themselves in a dangerous situation when climbing the ladder. People may also try to store tools and materials on the top rung of the ladder; however, the tools/materials could easily be knocked off and serious injury and/or messed would occur. Thus, a suitable solution is desired.

U.S. Pat. No. 5,603,405 to William H. Smith relates to a ladder top storage rack. The described ladder top storage rack includes a rigid tool box having securable to a ladder top. A pair of side pouches is secured to two side walls of the tool box. Each of the side pouches has a zippered opening. A rear pouch is secured to the rear wall of the tool box. The rear pouch has a zippered opening.

BRIEF SUMMARY OF THE INVENTION

In view of the foregoing disadvantages inherent in the known receptacles art, the present disclosure provides a novel ladder storage receptacle. The general purpose of the present disclosure, which will be described subsequently in greater detail, is to provide a storage receptacle for attachment to a ladder to provide easily accessible tools for a user.

A storage-receptacle is disclosed herein. The storage-receptacle may be used for attachment to a ladder and the ladder may include a plurality of steps having at least one top-step. The storage-receptacle includes a tray-housing which may include a tray-capacity defined by at least four tray-sides, a tray-base and an open-top opposite the tray-base and relative to the ladder; the tray-capacity being configured to store a plurality of items therein. Further, an attachment-means may be fixedly-attached to one of the at least four tray-sides, the attachment-means may include at least four attachment-sides, an attachment-top and an open-bottom opposite the attachment-top and relative to the ladder and the open-bottom may be configured for securement over the at least one top-step.

A method of using the storage-receptacle is also disclosed herein. The method of using the storage-receptacle may comprise the steps of: providing the storage-receptacle as above; securing the attachment-means over the at least one top-step of the ladder via the open-bottom; removably-placing at least one of the plurality of items into the tray capacity of the tray-housing; climbing the plurality of steps of the ladder; and using the at least one of the plurality of items whilst on the ladder.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a ladder storage receptacle, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a receptacles and more particularly to a ladder storage receptacle as used to improve the efficiency of storage of items while using a ladder.

Generally disclosed is a tool box including securement straps designed to be installed on the top of a ladder. The tool box may allow for quick, convenient, and safe access to numerous tools and materials needed to complete a job while working on ladders. The tool box may utilize hook and loop fastener straps on an underside of the box in order to firmly attach the tool box to a top step of the ladder, thus, eliminating the need for individuals to constantly step up and down a ladder to retrieve new tools or worksite materials.

The tool box may be a U-shaped storage container featuring ample space to store multiple tools and materials.

Further, the tool box may include a carrying handle, and utilize the hook and loop fastener straps on the underside of the box in order to be firmly secured to the ladder. Users may place tools and materials within the box and climb a ladder. The box may be secured to the top step/rung via the hook and loop fastener straps. In addition, the tool box may slip over the top step/rung of the ladder snuggly, substantially eliminating the worry of tools and materials becoming loose while working.

The tool box may be constructed using plastic, wood, and other suitable materials. The overall width on the outside edges may measure approximately 26.75", and overall length, from front to back, may measure approximately 12". The box may measure approximately 5" in depth in order to properly accommodate tools and materials. Exact size, measurement, construction, and design specifications may vary upon manufacturing.

Referring now more specifically to the drawings by numerals of reference, there is shown in FIGS. 1-4, various views of a storage-receptacle 100.

Figure 1:
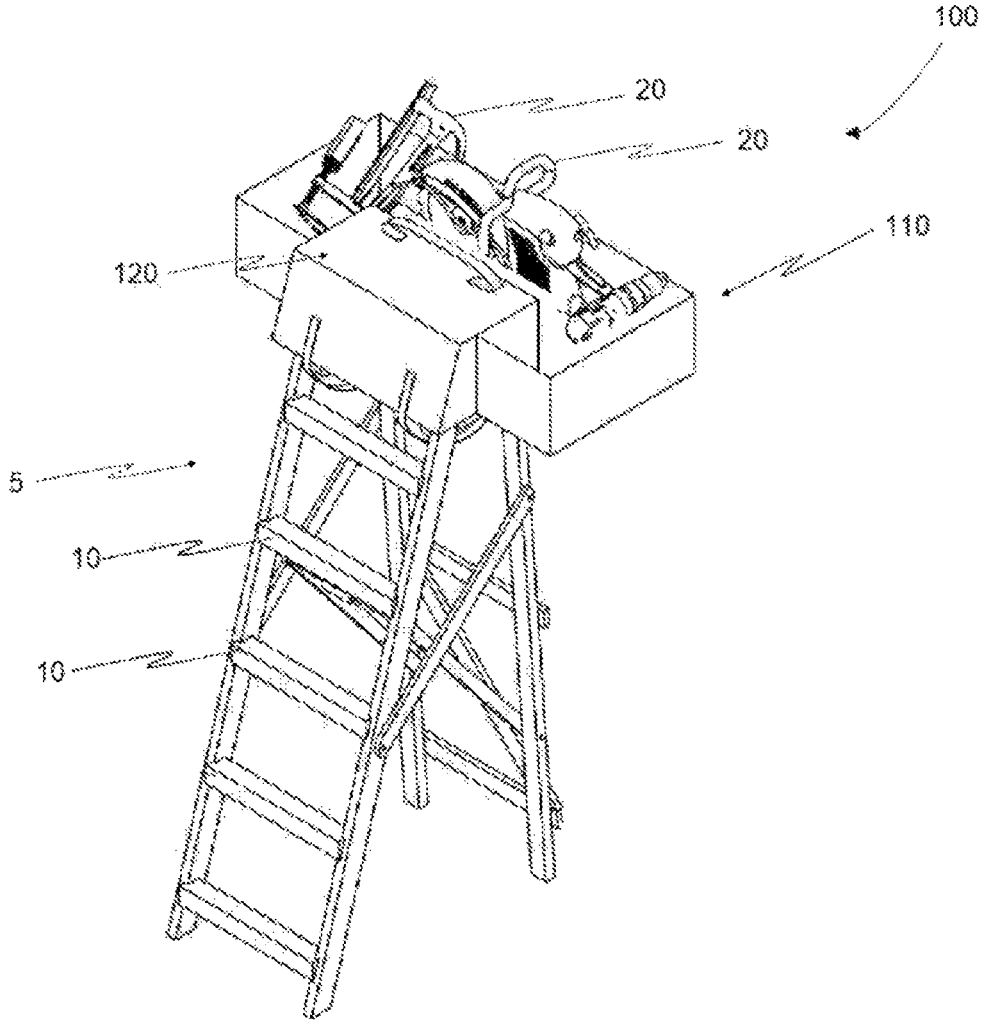
FIG. 1 is a front-side perspective view of the storage-receptacle during an 'in-use' condition, according to an embodiment of the disclosure.

FIG. 1 shows a storage-receptacle 100 during an 'in-use' condition 150, according to an embodiment of the present disclosure. As Illustrated, the storage-receptacle 100 may include a tray-housing 110 and an attachment-means 120. As shown, the storage-receptacle 100 for attachment to a ladder 5, the ladder 5 including a plurality of steps 10 having at least one top-step 15.

According to one embodiment, the storage-receptacle 100 may be arranged as a kit. The kit may include a set of user instructions. The instructions may detail functional relationships in relation to the structure of the storage-receptacle 100 (such that the storage-receptacle 100 can be used, maintained, or the like, in a preferred manner).

Figure 2:
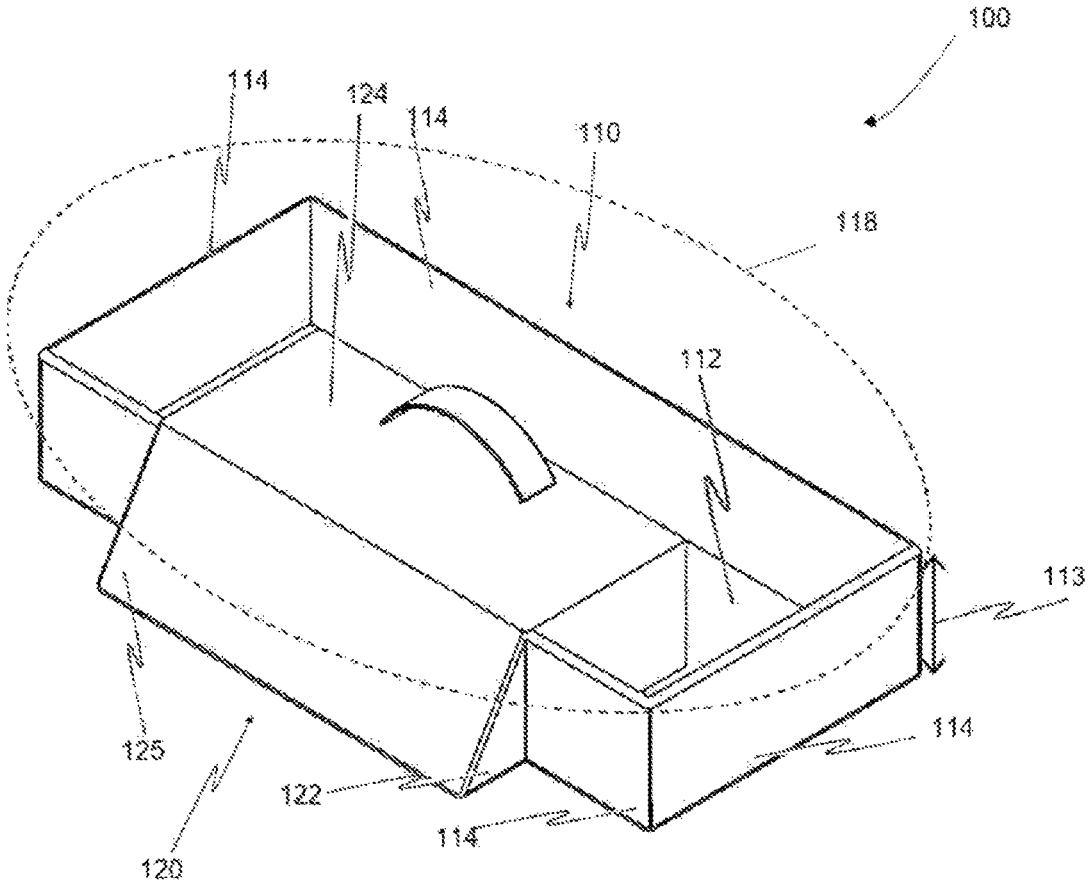
FIG. 2 is a front-side perspective view of the storage-receptacle of FIG. 1, according to an embodiment of the present disclosure.

Referring now to FIG. 2 showing a front-side perspective view of the storage-receptacle 100 of FIG. 1, according to an embodiment of the present disclosure. As shown, the tray-housing 110 may include a tray-capacity 112 defined by at least four tray-sides 114, a tray-base 116 and an open-top 118 opposite the tray-base 116 and relative to the ladder. The tray-capacity 112 may be configured to store a plurality of items 20 therein (FIG. 1). As illustrated, the tray-housing 110 may include a three-dimensional rectangular shape. Further, the tray-capacity 112 includes a tray-depth 113 of at least 5 inches.

The attachment-means 120 may be fixedly-attached to one of the at least four tray-sides 114, the attachment-means 120 including at least four attachment-sides 122, an attachment-top 124 and an open-bottom 126 (FIG. 4) opposite the attachment-top 124 and relative to the ladder, the open-bottom 126 (FIG. 4) being configured for securement over the at least one top-step 15. As shown and as above, the attachment-means 120 may include the three-dimensional rectangular-shape. In addition, one of the at least four attachment-sides 122 may include a slanted-side 125 and the slanted-side 125 may include an angle of at least 18 degrees. Further, as shown the attachment-top 124 may include a flat-surface 128 configured to hold at least one of the pluralities of items 20 during use of the ladder.

In a preferred embodiment, the tray-housing 110 may include a tray-length of at least 28⅛ inches, and the attachment-means 120 may include an attachment-length of at least 16⅜ inches. Further, the tray-housing 110 may include a tray-width of at least 12¼ inches. In this embodiment, a length from a rear-side of the tray-housing 110 and a front-side of the attachment-means 120 may be 15½ inches. However, other measurements may be used.

Figure 3:
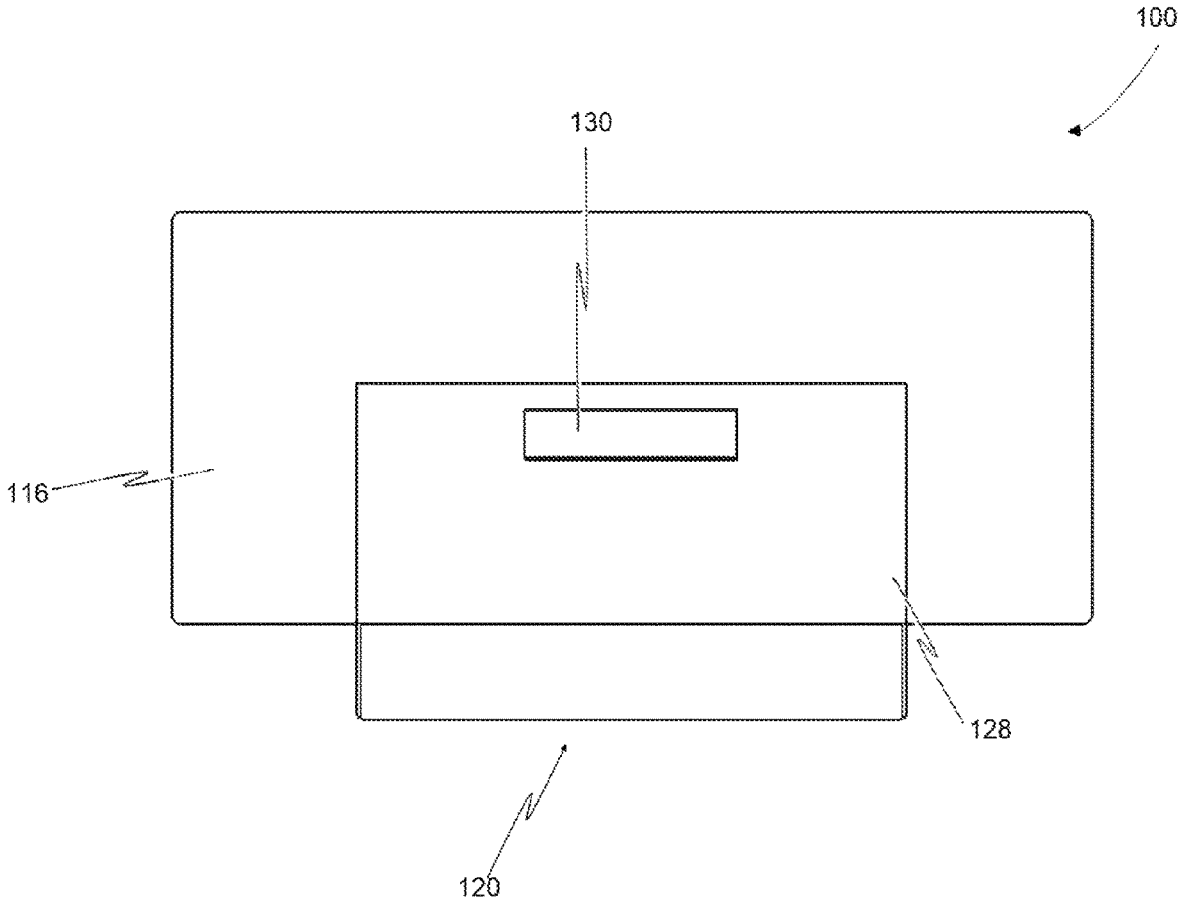
FIG. 3 is a top perspective view of the storage-receptacle of FIG. 1, according to an embodiment of the present disclosure.

FIG. 3 shows a top perspective view of the storage-receptacle 100 of FIG. 1, according to an embodiment of the present disclosure. As shown, the storage-receptacle 100 may further include a handle 130 attached to the attachment-top 124 and configured to aid in portability of the storage-receptacle 100. In a preferred embodiment, the tray-housing 110 and the attachment-means 120 may include a plastic material. In another embodiment, the tray-housing 110 and the attachment-means 120 may include a wood-material. However, it should be appreciated that other materials may be used. The plastic-material may be a thermosetting plastic to provide durability and strength. In some embodiments, the wood-material may be a plywood material. However, other materials may be used.

Figure 4:
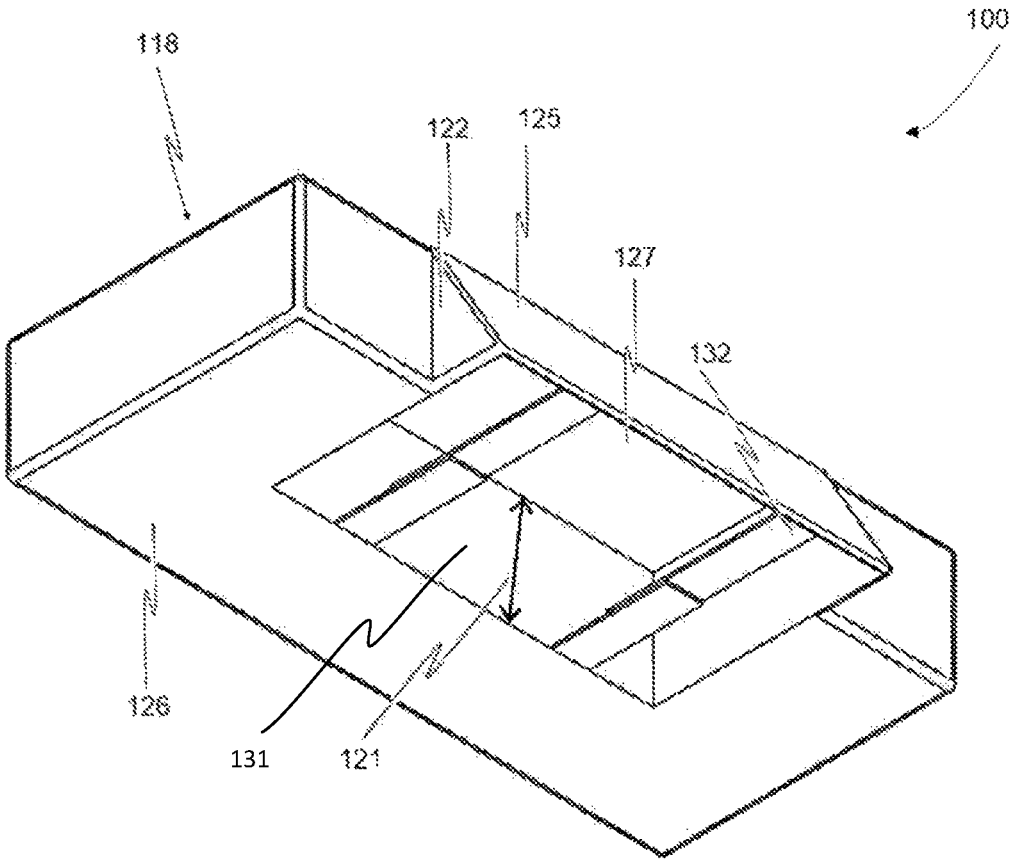
FIG. 4 is a bottom-side perspective view of the storage-receptacle of FIG. 1, according to an embodiment of the present disclosure.

Referring now to FIG. 4 showing a bottom-side perspective view of the storage-receptacle 100 of FIG. 1, according to an embodiment of the present disclosure. The at least four attachment-sides 122 and the attachment-top 124 (FIG. 3) may define a ladder-capacity 127 and the ladder-capacity 127 may be sized to receive and securely retain the at least one top-step 15 of the ladder. In one embodiment, the ladder-capacity 127 may include a common wall 131 having a ladder-depth 121 of the at least 5 inches.

As illustrated, at least one of the open-bottom 126 and the at least four attachment-walls may include at least one fastener 132 configured to aid in the securement of the open-bottom 126 over the at least one top-step 15 of the ladder. In a preferred embodiment, the at least one fastener 132 may located on the slanted-side 125. Further, in the preferred embodiment, the at least one fastener 132 may be two strips of hook and loop fastener 132. However, other fasteners 132 may be used. For example, snap fastener, hook and eye fasteners, and the like.

Figure 5:
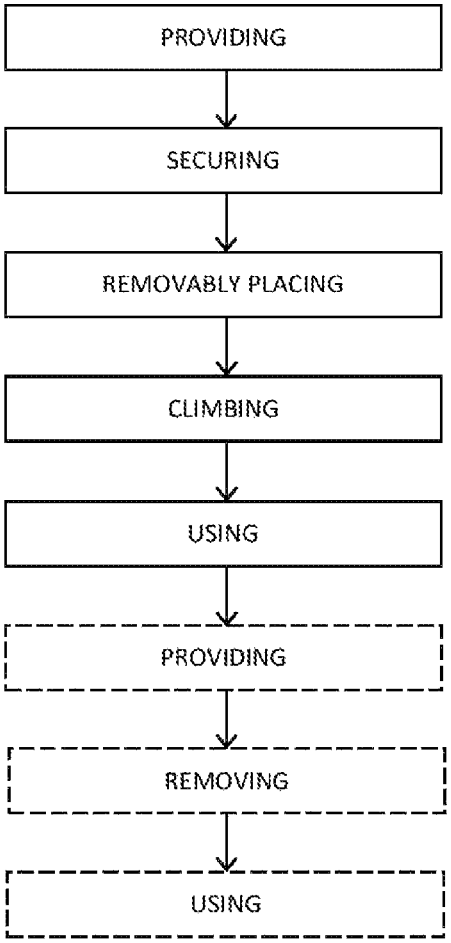
FIG. 5 is a flow diagram illustrating a method of use for the storage-receptacle, according to an embodiment of the present disclosure.

FIG. 5 is a flow diagram 550 illustrating a method of using a storage-receptacle on a ladder 500, according to an embodiment of the present disclosure. As illustrated, the method of using a storage-receptacle on a ladder 500 may include the steps of: step one 501, providing the storage-receptacle 100 as above; step two 502, securing the attachment-means 120 over the at least one top-step 15 of the ladder via the open-bottom 126; step three 503, removably-placing at least one of the plurality of items 20 into the tray-capacity 112 of the tray-housing 110; step four 504, climbing the plurality of steps 10 of the ladder 5; and step five 505, using the at least one of the plurality of items 20 whilst on the ladder 5. Further steps may include: step six 506, providing the storage-receptacle 100 further including a handle 130 attached to the attachment-top 124; step seven 507, removing the storage-receptacle 100 from the at least one top-step 15 of the ladder 5; and step eight 508, using the handle 130 to transport the storage-receptacle 100.

It should be noted that step six 506, step seven 507 and step eight 508 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for storage-receptacle 100 (e.g., different step orders within abovementioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A storage-receptacle for attachment to a ladder, the ladder including a plurality of steps having a top-step, the storage-receptacle comprising:

a tray-housing including a tray-capacity defined by at least three tray-sides, a common wall, and a planar U-shaped tray-base, the tray-capacity being configured to store a plurality of items therein; and an attachment element coupled to the tray-housing, the attachment element including at least three attachment-sides, the common wall, an attachment-top with a handle coupled to the attachment top configured to aid in portability of the storage-receptacle, and a bottom cavity defined by the at least three attachment-sides, the common wall, and the attachment-top, the bottom cavity being sized to receive at least a portion of the top-step.

2. The storage-receptacle of claim 1, wherein the bottom cavity is sized to receive and securely retain the top-step of the ladder.

3. The storage-receptacle of claim 1, wherein the attachment-top includes a flat-surface configured to hold at least one of the plurality of items during use of the ladder.

4. The storage-receptacle of claim 1, wherein the tray-capacity includes a tray-depth of at least 5 inches.

5. The storage-receptacle of claim 1, wherein the bottom cavity includes a ladder-depth of the at least 5 inches.

6. The storage-receptacle of claim 1, wherein one of the at least three attachment-sides includes a slanted-side.

7. The storage-receptacle of claim 6, wherein the slanted-side includes an angle of at least 18 degrees.

8. The storage-receptacle of claim 1, further comprising at least one fastener configured to aid in the securement of the bottom cavity over the top-step of the ladder.

9. The storage-receptacle of claim 8, wherein the at least one fastener includes two strips of hook and loop fastener.

10. The storage-receptacle of claim 9, wherein the at least one fastener is located on the slanted-side.

11. The storage-receptacle of claim 1, wherein the tray-housing and the attachment element includes a plastic material.

12. The storage-receptacle of claim 1, wherein the tray-housing and the attachment element includes a wood material.

13. The storage-receptacle of claim 1, wherein the common wall is rigid.

14. The storage-receptacle of claim 1, wherein the common wall is inflexible.

15. The storage-receptacle of claim 1, wherein the attachment-top is a continuous flat surface.

16. The storage-receptacle of claim 1, wherein the tray-housing has a first length, and the attachment element has a second length, the first length being greater than the second length.

* * * * *